US009949527B2

(12) United States Patent
Hau et al.

(10) Patent No.: US 9,949,527 B2
(45) Date of Patent: Apr. 24, 2018

(54) GOLF SANDAL

(71) Applicant: Swannies Footwear LLC, White Bear Lake, MN (US)

(72) Inventors: Michael Hau, Shoreview, MN (US); Joseph Hau, Shoreview, MN (US); Adam Iversen, Victoria, MN (US); Sam Swanson, White Bear Lake, MN (US); Matt Stang, White Bear Lake, MN (US); Chris Petersen, Greenville, MI (US)

(73) Assignee: Swannies Footwear LLC, White Bear Lake, MN (US)

( * ) Notice: Subject to any disclaimer, the term of this patent is extended or adjusted under 35 U.S.C. 154(b) by 0 days.

(21) Appl. No.: 15/179,491

(22) Filed: Jun. 10, 2016

(65) Prior Publication Data

US 2016/0374425 A1 Dec. 29, 2016

Related U.S. Application Data

(60) Provisional application No. 62/183,698, filed on Jun. 23, 2015, provisional application No. 62/287,639, filed on Jan. 27, 2016.

(51) Int. Cl.
*A43B 5/00* (2006.01)
*A43B 3/12* (2006.01)
(Continued)

(52) U.S. Cl.
CPC ..... *A43B 5/001* (2013.01); *A43B 3/122* (2013.01); *A43B 3/128* (2013.01); *A43B 13/04* (2013.01);
(Continued)

(58) Field of Classification Search
CPC ..... A43B 5/001; A43B 3/12; A43B 3/122; A43B 3/126; A43B 3/128; A43B 3/101;
(Continued)

(56) References Cited

U.S. PATENT DOCUMENTS 3,228,124 A * 1/1966 Schwarz ..... A43B 3/103 36/11.5
4,180,923 A * 1/1980 Dassler ..... A43B 13/223 36/32 R
(Continued)

FOREIGN PATENT DOCUMENTS

GB 2071481 A * 9/1981 ..... A43B 3/103

OTHER PUBLICATIONS

Acushnet Company; Golf Sandal; Website; 2014; http://www.footjoy.com/golf-sandal/016SPE.html.
(Continued)

*Primary Examiner* — Jameson Collier

(57) ABSTRACT

A golf sandal for providing comfort, stability, and superior traction. More specifically, a golf sandal having an outsole and midsole made of polyurethane, a gap between the outsole and the midsole, a strap having a central portion located in the gap between the outsole and midsole and ends that secure to each other, and a plurality of soft spikes on the bottom of the outsole, wherein each soft spike is the shape of a webbed foot. The soft spikes enable a wearer to have better traction compared to existing golf sandals.

18 Claims, 7 Drawing Sheets

(51) Int. Cl.

| | |
|---|---|
| ***A43B 23/28*** | (2006.01) |
| ***A43C 15/00*** | (2006.01) |
| ***A43B 13/12*** | (2006.01) |
| ***A43B 13/04*** | (2006.01) |
| ***A43B 13/22*** | (2006.01) |
| ***A43C 15/16*** | (2006.01) |
| ***A43C 15/02*** | (2006.01) |

(52) U.S. Cl.
CPC ..... *A43B 13/122* (2013.01); *A43B 13/223* (2013.01); *A43C 15/02* (2013.01); *A43C 15/16* (2013.01); *A43C 15/162* (2013.01)

(58) Field of Classification Search
CPC ..... A43B 3/102; A43B 3/103; A43B 3/105; A43B 1/0081; A43B 3/10; A43B 11/00; A43B 13/04; A43B 13/122; A43B 13/22; A43B 13/223; A43C 11/1493; A43C 15/02; A43C 15/16; A43C 15/162; A43C 15/165
USPC ..... 36/1, 4, 7.5, 7.6, 11.5, 59 R, 127
See application file for complete search history.

(56) References Cited

U.S. PATENT DOCUMENTS

| | | | | | |
|---|---|---|---|---|---|
| 4,314,412 | A * | 2/1982 | Anderson | A43B 3/12 | 36/100 |
| 4,419,836 | A * | 12/1983 | Wong | A43B 3/108 | 36/11.5 |
| 4,753,022 | A * | 6/1988 | Gasbarro | A43B 13/20 | 36/11.5 |
| 6,295,742 | B1 * | 10/2001 | Bathum | A43B 5/001 | 36/59 C |
| 6,497,056 | B1 * | 12/2002 | McGoveran | A43B 3/00 | 36/1 |
| 7,584,553 | B1 * | 9/2009 | Medley | A43B 5/001 | 36/11.5 |
| D698,532 | S * | 2/2014 | Mochen | D2/902 | |
| 2002/0078600 | A1 * | 6/2002 | Berg | A43B 1/0027 | 36/101 |
| 2004/0118016 | A1 * | 6/2004 | Tonkel | A43B 3/102 | 36/11.5 |
| 2005/0039344 | A1 * | 2/2005 | Berg | A43B 1/0027 | 36/11.5 |
| 2006/0021253 | A1 * | 2/2006 | Pasternak | A43B 13/223 | 36/59 C |
| 2007/0186443 | A1 * | 8/2007 | Berg | A43B 1/0027 | 36/11.5 |
| 2010/0223809 | A1 * | 9/2010 | Hensch | A43B 3/108 | 36/11.5 |
| 2014/0259738 | A1 * | 9/2014 | Yen | A43B 3/122 | 36/11.5 |
| 2015/0068063 | A1 * | 3/2015 | Farris | A43B 7/146 | 36/103 |

OTHER PUBLICATIONS

Reef; Reef Mulligan Golf Sandal; Website; 2006; http://wakeshop.hu/en/reef-mulligan-golf-sandal-332.

Golf Gators; Golf Gators Spackler Golf Flip Flop Sandal—Womens; Website; 2011; http://www.intheholegolf.com/GGAT-SFSW/Golf-Gators-Spackler-Golf-Flip-Flop-Sandal---Womens.html.

* cited by examiner

GOLF SANDAL

CROSS-REFERENCE TO RELATED APPLICATIONS

This application claims the benefit of U.S. Provisional Patent Application No. 62/287,639, filed on Jan. 27, 2016, titled GOLF SANDAL and U.S. Provisional Patent Application No. 62/183,698, filed on Jun. 23, 2015, titled GOLF SANDAL.

FIELD OF THE DISCLOSURE

The disclosed invention relates to a sandal. More specifically, the disclosed invention relates to a golf sandal that has soft spikes on the bottom to increase traction with the ground.

BACKGROUND OF THE INVENTION

Golf shoes typically take the form of a closed-toed shoe. Overall, golfers desire the ability to play in comfortable, casual, and high-performance footwear. However, many golfers want a light, functional, breathable golf shoe, which leads to a desire for some golfers to wear sandals. Currently, there are very limited options for golf sandals in the market today. Existing golf sandals have limited traction and use, are outdated, uncomfortable, and not aesthetically pleasing. Further, they use old spike designs, wherein the spikes are hard spikes and limit the functionality of the sandal to the golf course.

The game of golf is becoming a more casual environment with a more social atmosphere, and new golfers desire sandals that look less outdated. They also want footwear that can be worn on and off the course. Because of the lack of options, new golfers are wearing traditional sandals that are not designed for golf, which reduce their traction and stability and can cause inadvertent health problems. Therefore, a golf sandal is needed that is versatile, comfortable, and functional.

SUMMARY OF THE INVENTION

Disclosed is a golf sandal with an innovative soft spike pattern, wherein the soft spike pattern offers comfort, stability, and superior traction and further enables the golf sandal to be worn both on and off the course.

In some embodiments, each spike on the bottom of the sandal is designed in the shape of a webbed foot, such as a swan's foot, to increase traction with the ground. The sandal is designed to be stylish and casual for use by the social golfer for wear on and off the golf course.

In addition to the soft spike pattern, the golf sandal has an increased concavity in the footbed to provide significant stability and arch support. The footbed also has moisture wicking capabilities that increase a wearer's grip and reduces the wearer's slip.

DETAILED DESCRIPTION

Figure 1:
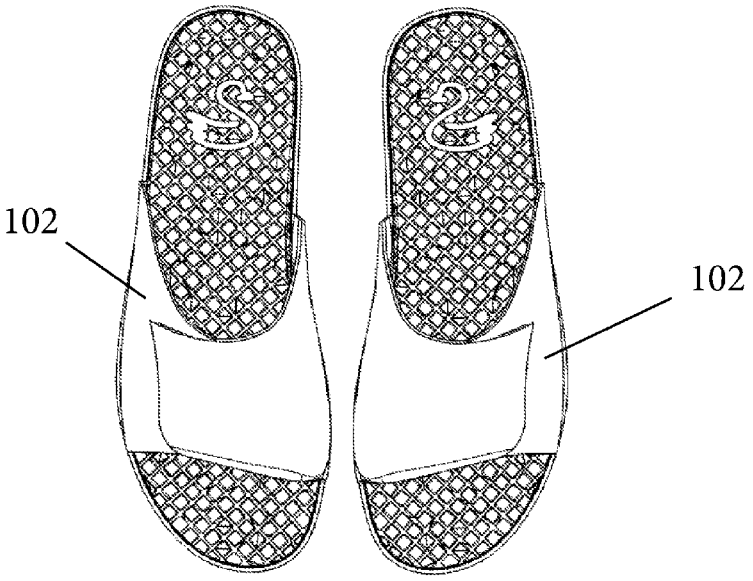
FIG. 1 is a top view of one embodiment of the disclosed golf sandal.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims. It is understood that various omissions and substitutions of equivalents are contemplated as circumstances may suggest or render expedient, but these are intended to cover applications or embodiments without departing from the spirit or scope of the claims attached hereto. Also, it is to be understood that the phraseology and terminology used herein are for the purpose of description and should not be regarded as limiting.

Figure 2:
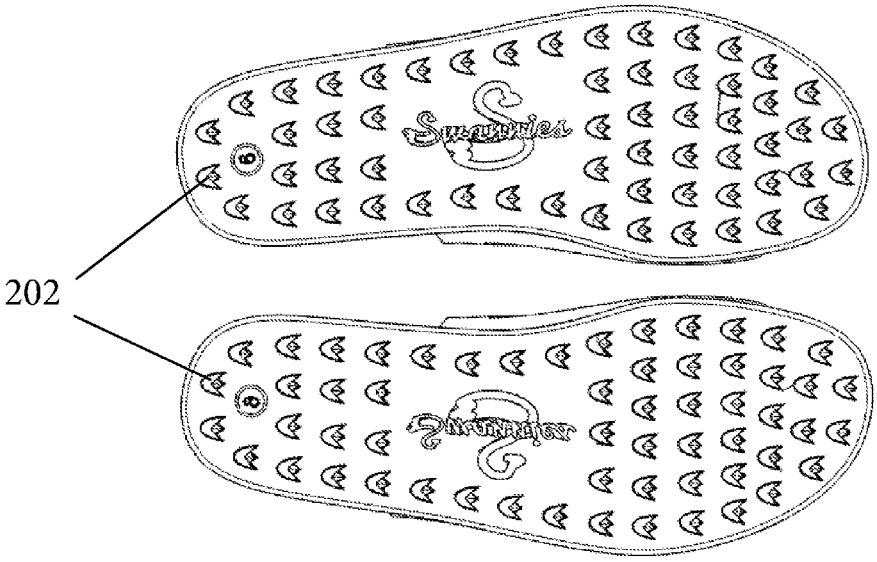
FIG. 2 is a bottom view of one embodiment of the disclosed golf sandal.
Figure 3:
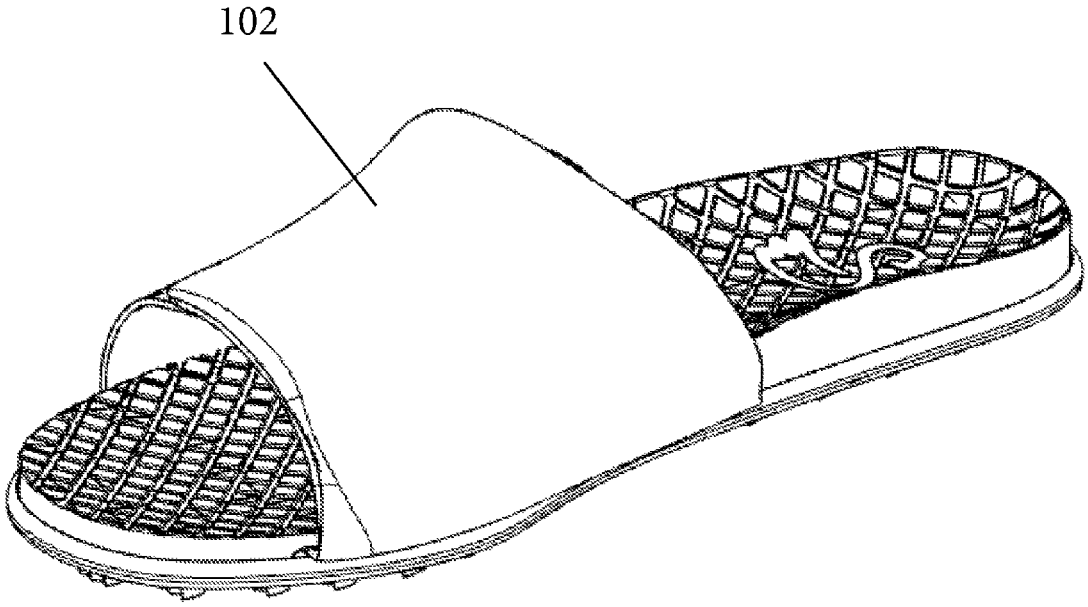
FIG. 3 is a front perspective view of one embodiment of the disclosed golf sandal.
Figure 4:
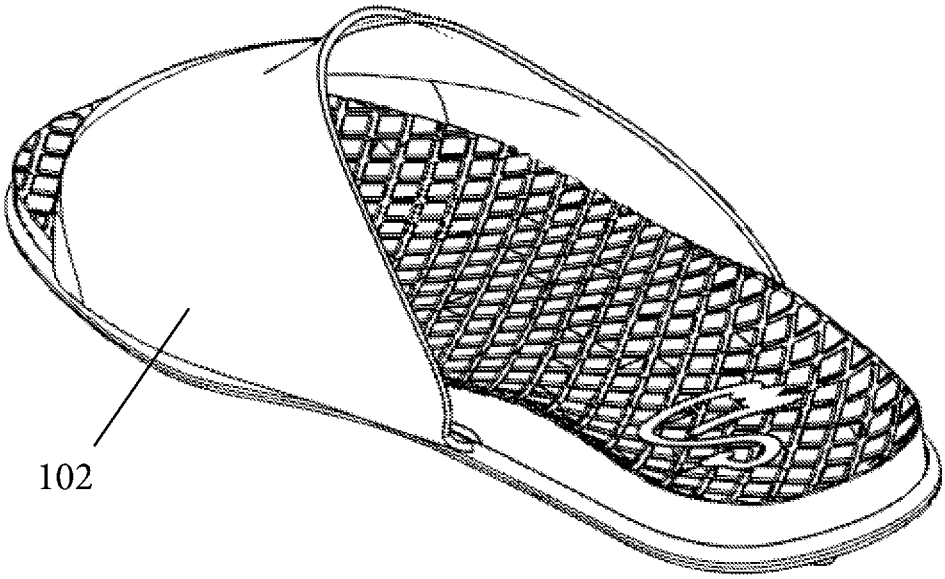
FIG. 4 is a back perspective view of one embodiment of the disclosed golf sandal.

In one embodiment, the disclosed golf sandal includes an outsole 902, a midsole 904, a strap 102, and traction points such as, but not limited to, soft spikes 202 attached to and/or protruding from the base of the outsole 902. FIGS. 1-2 show an illustrative example of this embodiment, wherein FIG. 1 shows the midsole 904 and the strap 102 and FIG. 2 shows the outsole 902 and the soft spikes 202 on the base of the outsole 902. In some embodiments, the golf sandal weighs approximately 12 ounces.

The outsole 902, in some embodiments, can be made of a polyurethane material. In other embodiments, the outsole 902 can be made of a lightweight natural rubber. One method of creating the outsole 902 is by injecting a natural rubber into a mold of the outsole 902. In some embodiments, the height of the outsole 902 from base to top can range from approximately 18 mm to 20 mm. In other embodiments, the height can range from approximately 4.5 mm to 7 mm. For example, as illustrated in FIGS. 9-14, the outsole 902 is approximately uniform in thickness. In some embodiments, the outsole 902 has a thicker portion along its outer circumference that acts as a wall by surrounding the midsole 904 and protecting the outer edge or circumference of the midsole 904. However, in some embodiments, the thicker portion along the outer circumference of the outsole 902 is less prominent, and instead of a wall, may be a small lip on the edge of the sandal, as illustrated in FIGS. 9-14. Therefore, the outsole 902 can be a flat piece with a small lip, and the small lip can be limited in its location to a portion of the sandal, such as the heel. In some embodiments, the thicker portion of the outsole 902 is absent and there is no wall or lip portion that protects the outer edge or circumference of the midsole 904.

Figure 5:
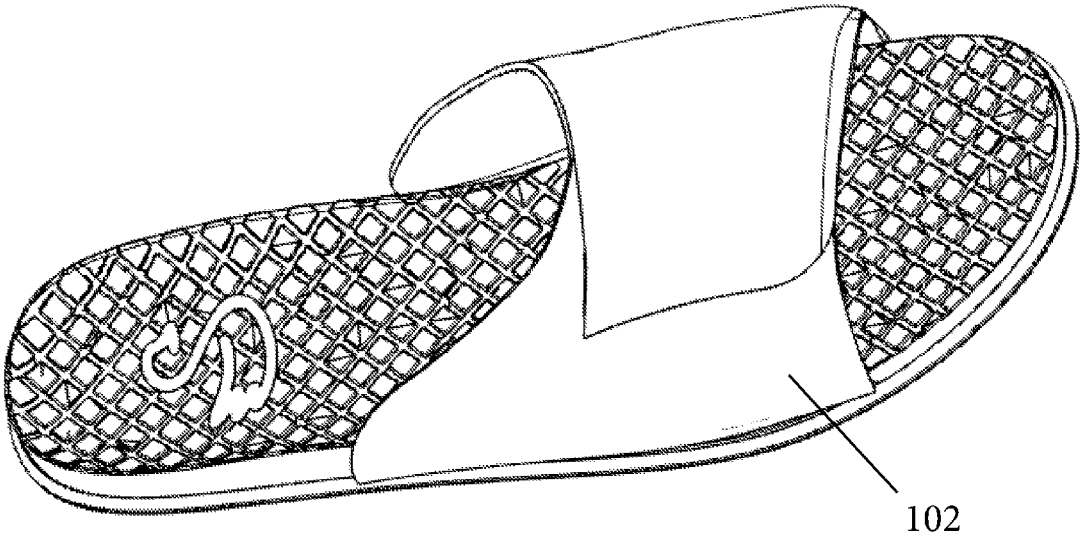
FIG. 5 is a top perspective view of one embodiment of the disclosed golf sandal.
Figure 6:
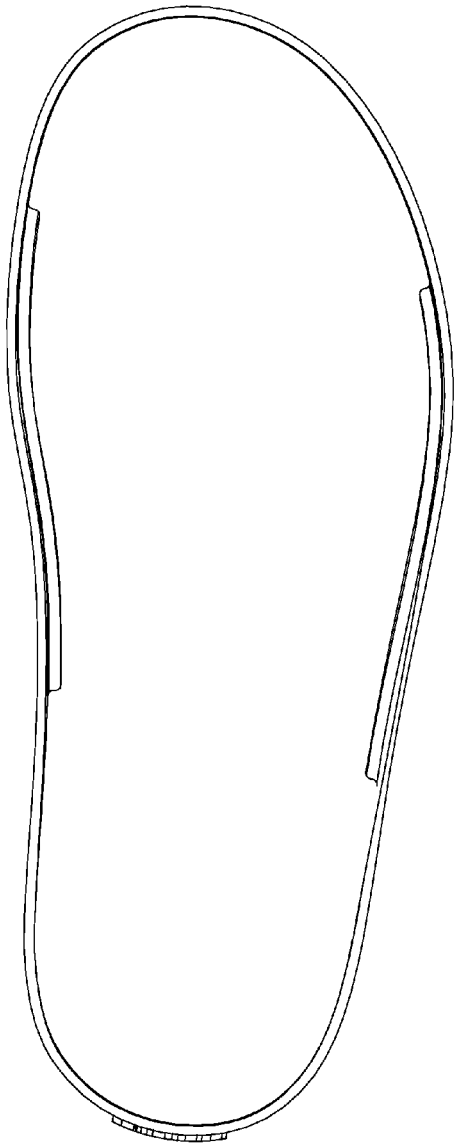
FIG. 6 is a top view of the sole of one embodiment of the disclosed golf sandal.
Figure 7:
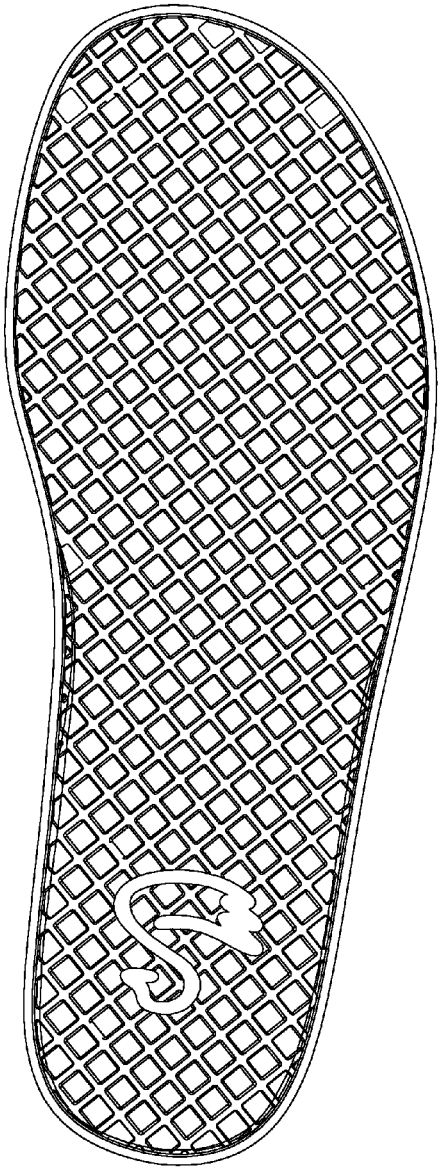
FIG. 7 is a top view of the sole of one embodiment of the disclosed golf sandal.
Figure 8:
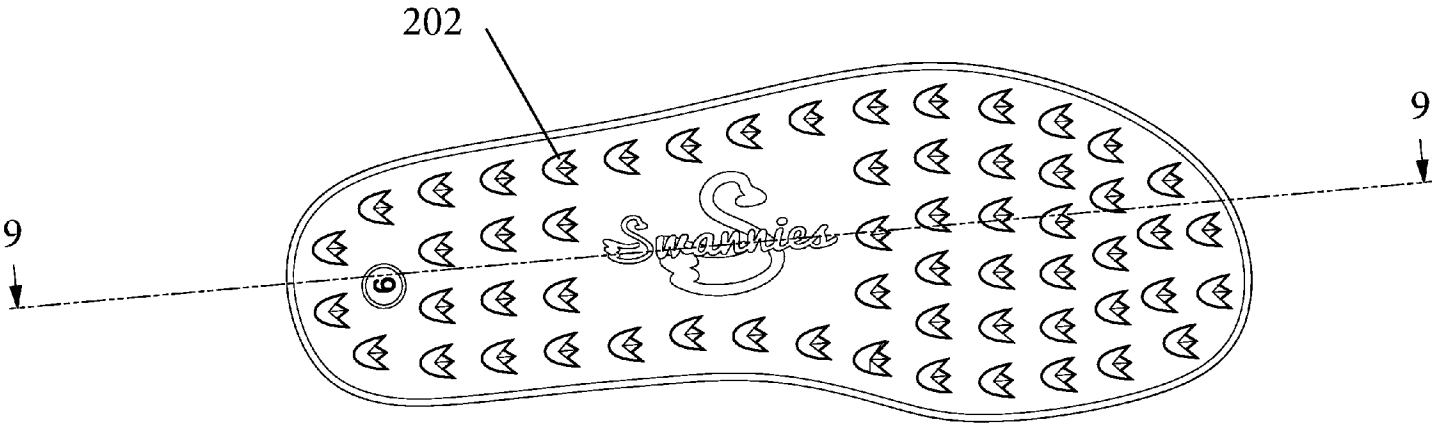
FIG. 8 is a bottom view of one embodiment of the disclosed golf sandal.

The midsole 904, illustrated in FIGS. 1, 3-7, 9 and 13-14, is located on top of the outside 902 and can be made of memory foam. For example, in some embodiments, the midsole 904 is manufactured by injecting polyurethane memory foam into a mold. The midsole 904 can be covered with an additional material such as, but not limited to, synthetic leather or another polyurethane material, wherein the additional material can be moisture wicking and can add grip. The synthetic leather, which lines the midsole 904, can be made from lightweight and soft polyurethane material. Further, the surface of the midsole 904 can contain a diamond texture, as illustrated in FIGS. 1, 3-5, and 7, that adds grip, and that is approximately 0.14 mm high, but can be taller or shorter. However, some embodiments of the midsole 904 can have a smooth surface, as illustrated in FIG. 6. In some embodiments, heel cupping exists on the back of the midsole 904, as illustrated in FIGS. 1, 3-5, and 11-13, and an outer portion of the midsole can be approximately three to six mm taller than the remainder of the midsole 904. Therefore, to accommodate the shape of a user's foot and to hold the user's foot in the sandal, the height of the midsole 904 can vary. In some embodiments, as illustrated in FIGS. 9-12 and 14, a gap 906 exists between the midsole 904 and the outsole 902 to allow the strap to slide through the sandal and between the two soles.

Figure 9:
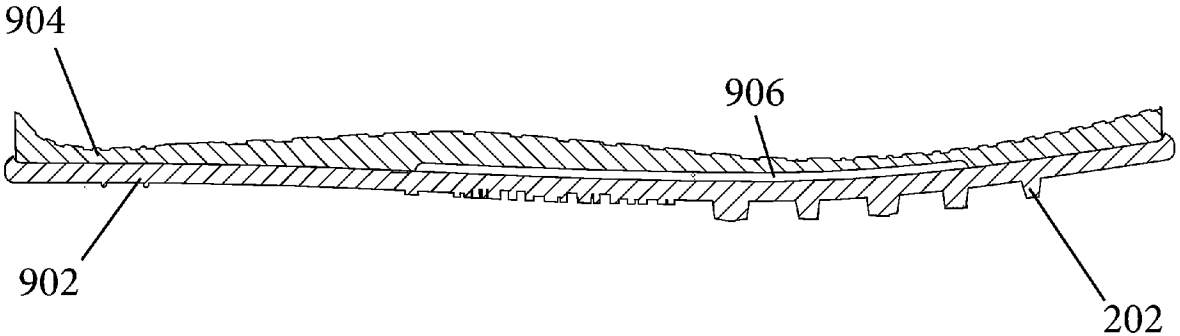
FIG. 9 is a cross-sectional view of the disclosed golf sandal taken from the line 9-9 in FIG. 8.
Figure 10:
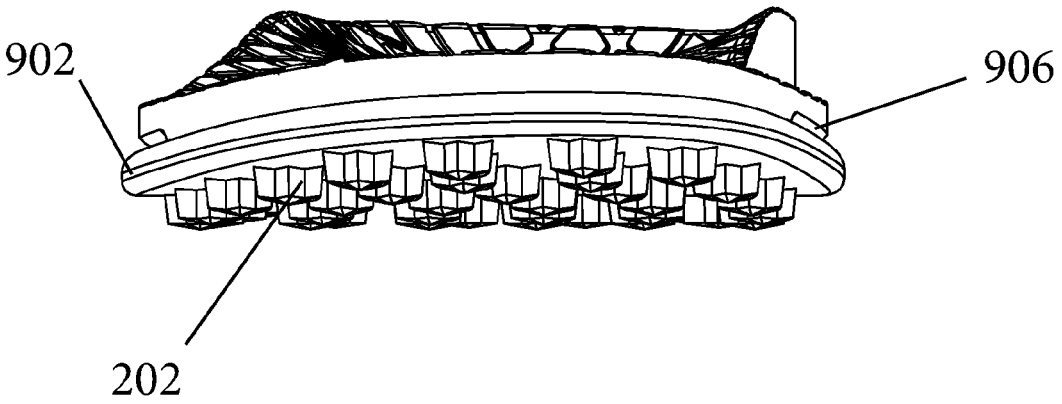
FIG. 10 is a front view of the sole of one embodiment of the disclosed golf sandal.
Figure 11:
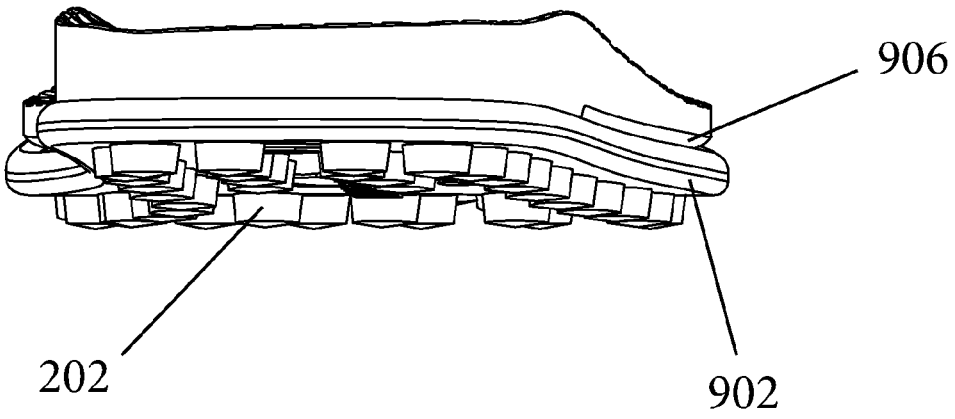
FIG. 11 is a back view of the sole of one embodiment of the disclosed golf sandal.
Figure 12:
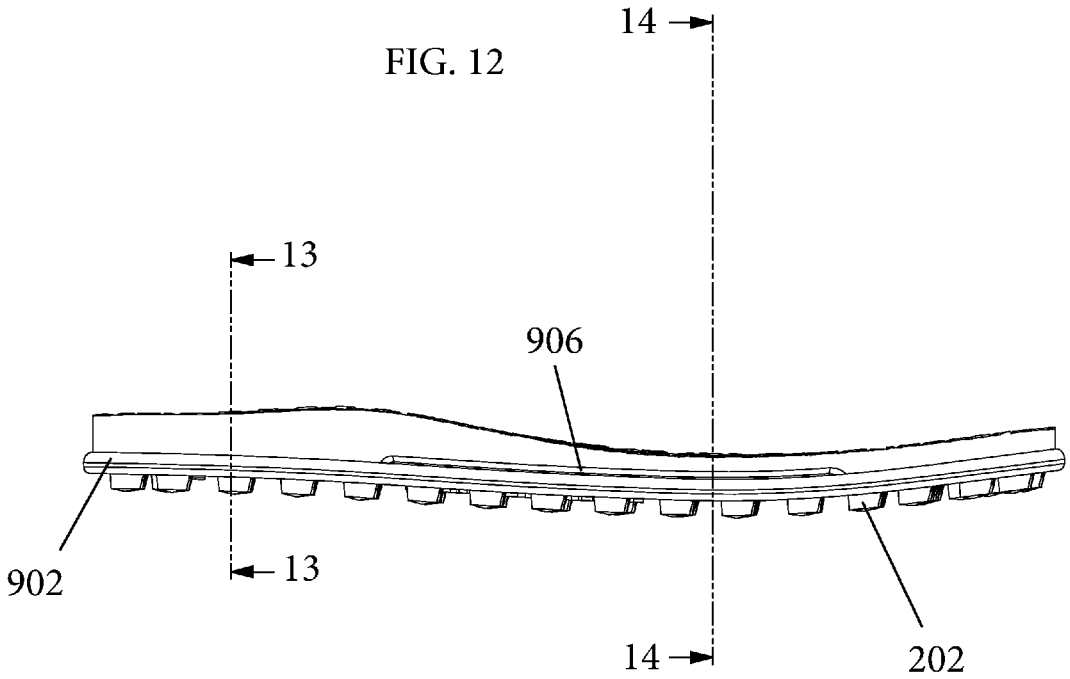
FIG. 12 is a left side view of the sole of one embodiment of the disclosed golf sandal.
Figure 13:
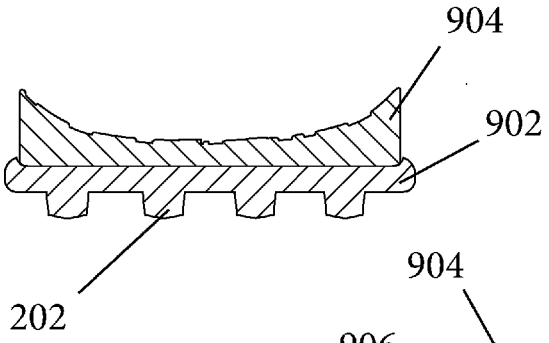
FIG. 13 is a cross-sectional view of the sole of the disclosed golf sandal taken from the line 13-13 in FIG. 12.
Figure 14:
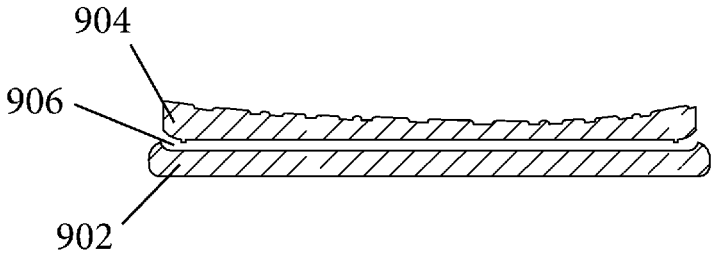
FIG. 14 is a cross-sectional view of the sole of the disclosed golf sandal taken from the line 14-14 in FIG. 12.

In some embodiments, the golf sandal has an increased concavity in the footbed of the midsole 904, as illustrated in FIG. 9, to provide significant stability and arch support. For example, the ball and heel portions of the footbed can be depressed more than the remainder of the footbed. This depression ensures that during a golf swing, when a large amount of torque is created, the wearer's foot remains in the sandal. The footbed can also have moisture wicking capabilities that can increase a wearer's grip and reduce the wearer's slip.

The strap 102 of the golf sandal can be made out of a variety of materials such as, but not limited to, natural leather, synthetic leather, and vinyl. For example, the strap 102 may be kidskin leather on top with a pig lining liner on the strap's underside. In some embodiments, the strap 102 can be manufactured using a metal dye to cut out the shape. The strap 102 is generally wider than typical sandals in order to aid a user in remaining in the sandal while playing golf.

In some embodiments, the strap 102 is a one-piece strap. The ends of the strap, if the strap 102 is a linear piece of material, can be secured in the gap 906 between the outsole 902 and the midsole 904. If the strap 102 is one one continuous piece of material, it can loop through the gap 906.

In another embodiment, the strap 102 is an adjustable, one-piece strap, wherein the strap 102 is a linear piece of material, the central portion of the strap runs through the gap 906 between the outsole 902 and the midsole 904, and the ends of the strap are comprised of a top and bottom strap that connect to each other near the top of the user's foot, as illustrated in FIGS. 1 and 5. This configuration enables the user to adjust the strap's size. For example, a user may desire the fit of the sandal to be loose, and may therefore adjust the ends of the top and bottom straps so that there is less overlap between them.

To secure the top and bottom strap ends to each other, a hook and loop feature may be installed. For example, the hook feature of the hook and loop may be installed on the top (or bottom) of one of the strap ends and the loop feature of the hook and loop may be installed on the bottom (or top) of the other strap end. More specifically, the hook feature can be installed on the top surface of the bottom strap and the loop feature can be installed on the bottom surface of the top strap. Alternatively, the hook feature can be installed on the bottom surface of the top strap and the loop feature can be installed on the top surface of the bottom strap. Therefore, when the hook and loop features overlap, they will attach to each other, effectively permitting the strap 102 to secure itself at various sizes. The installation of the hook and loop features on the strap 102 may take place using a heating agent. In some embodiments, instead of a hook and loop securing mechanism, the top and bottom strap ends may secure to each other using snap buttons, button fasteners, buckles, zippers, etc.

In a further embodiment, the strap is an adjustable, two-piece strap 102 similar to the one-piece strap with ends, but where each of the two pieces has an end between the outsole 902 and midsole 904 and an end that overlaps with the other strap piece, as illustrated in FIGS. 1 and 3-5. More specifically, the first end of each piece of the strap 102 can be secured between the outsole 902 and the midsole 904 and the second end can overlap with the other strap piece near the top or side of the wearer's foot, enabling the user to adjust the strap's size. As described above, the two adjustable pieces may secure to each other using a hook and loop feature or any other securing mechanism.

The outsole 902 and midsole 904 can be glued together to finalize the base of the golf sandal. In some embodiments, the outsole 902 and midsole 904 are glued together with the strap ends wedged in between them so that, when the outsole 902 and midsole 904 are glued together, the strap is also secured. In other embodiments, the strap 102 can be independently attached to the base of the golf sandal by being sewn or glued on. As described above, a gap 906 may exist between the midsole 904 and the outsole 902 to allow the strap to slide between the two soles. The gap 906 can be approximately 2 mm in height, but can be taller or shorter.

The soft spikes 202 on the bottom of the golf sandal, illustrated in FIGS. 2 and 8-13, can range from approximately one to four mm tall, but can be taller or shorter. In some embodiments, the soft spikes 202 can take various shapes such as, but not limited to, webbed feet, such as swan feet. The shape of the soft spikes 202, namely the shape of a webbed foot, is important because the narrow extensions off of the main body of each soft spike 202 (for example, the three "toes" of each webbed foot) enables the golf sandal to better grip the ground and, therefore, offers the wearer better traction on the ground.

The soft spikes 202 can be small enough in size to fit up to eight spikes across the widest portion of the golf sandal and up to twenty spikes along the longest portion of the golf sandal. Therefore, several small soft spikes 202 can be included on the base of the golf sandal instead of a few large soft spikes 202. However, the soft spikes 202 can be of various sizes and are not required to be small. In a preferred embodiment, the sandal can fit six soft spikes 202 in line across the widest portion of the golf sandal and sixteen soft spikes 202 in linear rows along the longest portion of the golf sandal. For example, the sandal may have sixteen rows of soft spikes 202, wherein the first row can fit two soft spikes 202, the second row can fit three soft spikes 202, the third row can fit four soft spikes 202, the fourth row can fit four soft spikes 202, the fifth row can fit four soft spikes 202, the sixth row can fit four or five soft spikes 202, the seventh row can fit four or five soft spikes 202, the eighth row can fit four or five soft spikes 202, the ninth row can fit five soft spikes 202, the tenth row can fit five soft spikes 202, the eleventh row can fit six soft spikes 202, the twelfth row can fit six soft spikes 202, the thirteenth row can fit six soft spikes 202, the fourteenth row can fit five soft spikes 202, the fifteenth row can fit four potentially offset soft spikes 202, and the sixteenth row can fit two soft spikes 202.

What is claimed is:

1. A golf sandal comprising:

an outsole having a bottom, a top, a toe end, a heel end opposite the toe end, a medial side extending between the toe end and the heel end, and a lateral side opposite the medial side and extending between the toe end and the heel end;

a midsole having a bottom, a top, a toe end, a heel end, a concave footbed, and a heel cup at the heel end, wherein the bottom of the midsole is in contact with the top of the outsole;

a gap between the top of the outsole and the bottom of the midsole;

a strap having a central portion, a first end, and a second end, wherein:

the first and second ends overlap and secure to each other above the top of the midsole in a secured position using a hook and loop attachment system on the strap; and the central portion of the strap is located in the gap between the outsole and the midsole; and a plurality of soft spikes located on the bottom of the outsole, wherein:

each soft spike is in the shape of a webbed foot, each soft spike having a first end and a second end, a main body at the first end of the soft spike, and at least three prongs extending from the main body to the second end of the soft spike; and the plurality of soft spikes are arranged in multiple linear rows positioned from the toe end of the outsole to the heel end of the outsole, each row extending from the first medial of the outsole to the lateral side of the outsole, wherein each soft spike in each row is positioned with the three prongs positioned towards the toe end and the main body positioned towards the heel end.

2. The golf sandal of claim 1, wherein at least part of the outsole forms a protective lip for at least a portion of an outer edge of the midsole.

3. The golf sandal of claim 2, wherein the protective lip is at an outer portion of the heel cup.

4. The golf sandal of claim 1, wherein the top of the midsole has a gripping texture with a diamond-shaped pattern.

5. The golf sandal of claim 4, wherein the midsole comprises a moisture wicking material.

6. The golf sandal of claim 1, wherein an outer portion of the heel cup of the midsole is between three millimeters (mm) and six mm taller than a remainder of the heel cup.

7. The golf sandal of claim 1, wherein the strap is comprised of a material comprising at least one of leather, acrylic, and synthetic leather.

8. The golf sandal of claim 1, wherein the gap has a thickness between the outsole and the midsole, and the thickness is at least two mm.

9. The golf sandal of claim 1, wherein the outsole has sixteen linear rows of soft spikes.

10. The golf sandal of claim 1, wherein at least one of the linear rows has six soft spikes.

11. The golf sandal of claim 1, wherein the main body of each soft spike within one linear row is aligned with the main body of an adjacent soft spike within the one linear row.

12. The golf sandal of claim 1, wherein an end of at least one of the prongs of each soft spike within one linear row is aligned with the end of at least one prong of the prongs of an adjacent soft spike within the one linear row.

13. The golf sandal of claim 1, wherein the strap is slidably positioned within the gap.

14. The golf sandal of claim 13, wherein the strap is removable.

15. The golf sandal of claim 1, wherein the strap is made of a strap material, the outsole is made of an outsole material, and the midsole is made of a midsole material, wherein the strap material is different from at least one of the outsole material and the midsole material.

16. The golf sandal of claim 1, wherein the soft spikes are made of a polyurethane material.

17. The golf sandal of claim 1, wherein the multiple linear rows comprise:

a first linear row substantially near the toe end of the outsole; and a second linear row adjacent to the first linear row, the second linear row positioned towards the heel end of the outsole relative to the first linear row;

wherein the second linear row has at least one more soft spike than the first linear row.

18. The golf sandal of claim 17, wherein the multiple linear rows further comprise:

a heel end linear row substantially near the heel end of the outsole, the heel end linear row having fewer soft spikes than the second linear row.

* * * * *